US009601273B2

(12) United States Patent
Lin

(10) Patent No.: US 9,601,273 B2
(45) Date of Patent: Mar. 21, 2017

(54) WINDING DEVICE AND WINDING METHOD

(71) Applicant: KABUSHIKI KAISHA TOSHIBA, Minato-ku (JP)

(72) Inventor: Chiayu Lin, Yokohama (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 472 days.

(21) Appl. No.: 14/206,247

(22) Filed: Mar. 12, 2014

(65) Prior Publication Data

US 2015/0090829 A1 Apr. 2, 2015

(30) Foreign Application Priority Data

Sep. 30, 2013 (JP) ..... 2013-205916

(51) Int. Cl.
*H01F 41/06* (2016.01)
*H01F 41/04* (2006.01)

(52) U.S. Cl.
CPC ..... *H01F 41/04* (2013.01); *H01F 41/064* (2016.01); *H01F 41/074* (2016.01); *H01F 41/082* (2016.01)

(58) Field of Classification Search
CPC .... H01F 41/064; H01F 41/082; B65H 57/006
See application file for complete search history.

(56) References Cited

U.S. PATENT DOCUMENTS 5,333,800 A * 8/1994 Takahata ..... H01F 41/082 140/92.2
5,547,532 A 8/1996 Wernersbach, Jr. et al.
2001/0011413 A1* 8/2001 Yamaguchi ..... G06K 19/07749 29/600
2001/0015393 A1 8/2001 Miyazaki et al.
(Continued)

FOREIGN PATENT DOCUMENTS

CN 101615508 A 12/2009
CN 102853046 A 1/2013
(Continued)

OTHER PUBLICATIONS

U.S. Appl. No. 14/637,573, filed Mar. 4, 2014, Lin.
(Continued)

*Primary Examiner* — Emmanuel M Marcelo
(74) *Attorney, Agent, or Firm* — Oblon, McClelland, Maier & Neustadt, L.L.P.

(57) ABSTRACT

According to one embodiment, a winding device includes a supporting part, a pressing part, a movement part configured to move a positional relationship between the supporting part and the pressing part, a control part, a target movement speed calculation part configured to detect a target relative movement speed of the pressing part with respect to the supporting part, a wire feed speed detection part configured to detect a feed speed of the wire, a deviation amount calculation part configured to calculate a difference between a detection result of the target movement speed calculation
(Continued)

part and a detection result of the wire feed speed detection part, and a determination part configured to determine that the wire has deviated from the movement path.

14 Claims, 5 Drawing Sheets

(56) References Cited

U.S. PATENT DOCUMENTS

| | | | | |
|---|---|---|---|---|
| 2012/0037264 | A1* | 2/2012 | Sakabe | B21C 47/04<br>140/71 C |
| 2013/0341454 | A1* | 12/2013 | Osawa | H01F 41/0654<br>242/437.3 |

FOREIGN PATENT DOCUMENTS

| | | | |
|---|---|---|---|
| DE | 199 07 973 | A1 | 9/1999 |
| JP | 57-196855 | A | 12/1982 |
| JP | 8-51042 | | 2/1996 |
| JP | 2010-10484 | A | 1/2010 |

OTHER PUBLICATIONS

Combined Chinese Office Action and Search Report issued on May 24, 2016 in Patent Application No. 201410338881.8 (with English language translation).

* cited by examiner

WINDING DEVICE AND WINDING METHOD

CROSS-REFERENCE TO RELATED APPLICATION

This application is based upon and claims the benefit of priority from Japanese Patent Application No. 2013-205916, filed Sep. 30, 2013; the entire contents of which are incorporated herein by reference.

FIELD

Embodiments described herein relate generally to a winding device for winding a wire to a work and a winding method of winding a wire to a work.

BACKGROUND

A winding device for winding a wire in a predetermined position of a work in order to form a coil has been proposed. This type of winding device comprises a pressing member interposing the wire between the pressing member and the work, and a movement device. The movement device moves the pressing member along a path set in advance on the work. In this case, the path set in advance is determined on the basis of the shape of a desired coil.

Since the movement device moves the pressing member in a state in which the wire is interposed between the work and the pressing member, a coil is formed on the work.

In this type of winding device, when an operator visually recognizes that the wire has deviated from the path set on the work, the device is stopped. After interposing the wire between the pressing member and the work, the operator resumes operation of the winding device.

DETAILED DESCRIPTION

According to one embodiment, a winding device includes a supporting part, a pressing part, a movement part, a control part, a target movement speed calculation part, a wire feed speed detection part, a deviation amount calculation part, a determination part.

The supporting part is configured to support a wire. The pressing part is configured to interpose the wire between the supporting part and the pressing part. The movement part is configured to move a positional relationship between the supporting part and the pressing part. The control part is configured to control an operation of the movement part. The target movement speed calculation part is configured to detect a target relative movement speed of the pressing part with respect to the supporting part on the basis of information on a predetermined movement path on which the pressing part moves with respect to the supporting part and operation information on the movement part. The wire feed speed detection part is configured to detect a feed speed of the wire involved in the relative movement of the pressing part with respect to the supporting member. The deviation amount calculation part is configured to calculate a difference between a detection result of the target movement speed calculation part and a detection result of the wire feed speed detection part. The determination part is configured to determine that the wire has deviated from the movement path on the basis of a result of calculation of the deviation amount calculation part.

Figure 1:
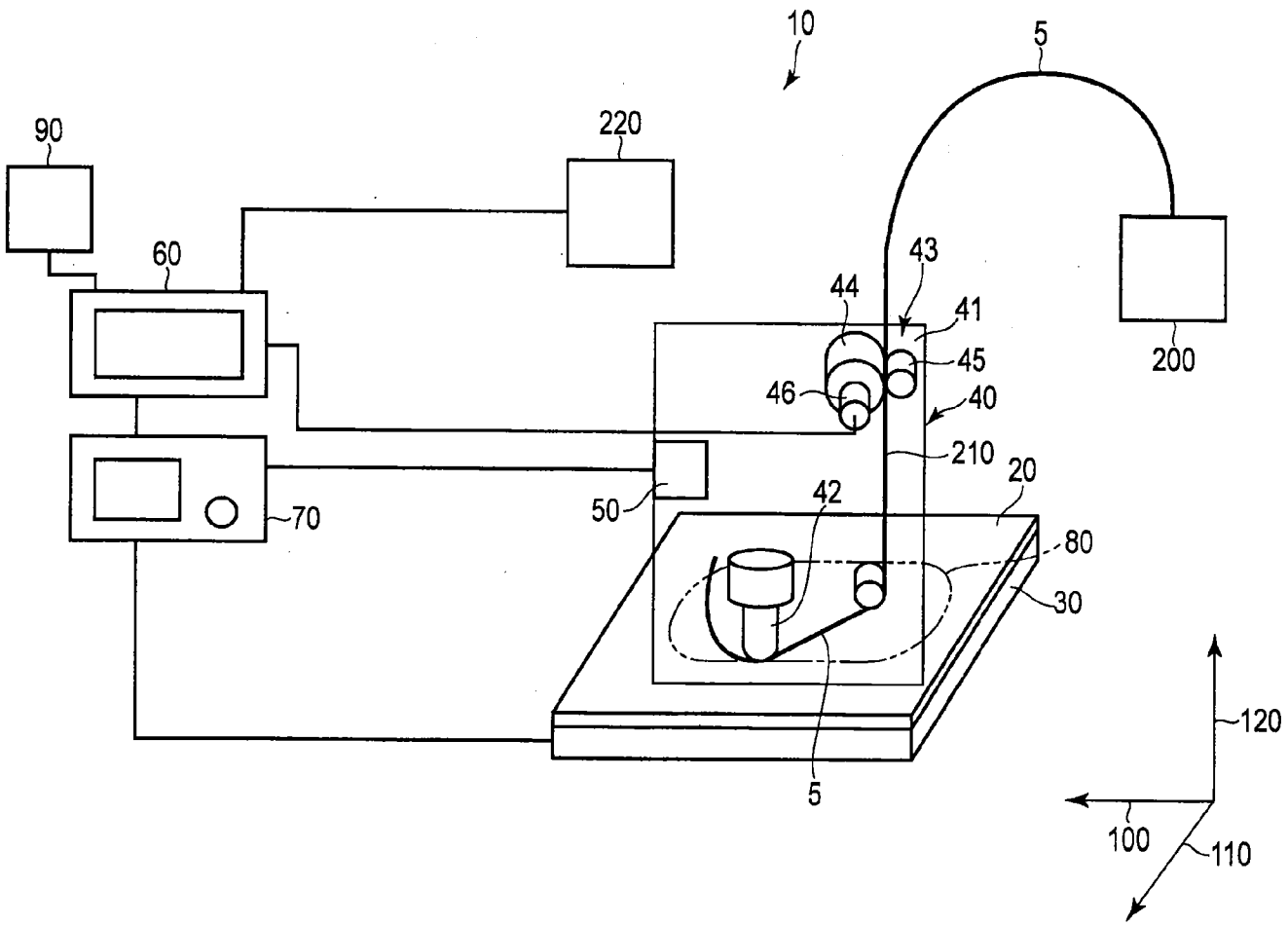
FIG. 1 is a schematic view illustrating a winding device according to the first embodiment.

A winding device and a winding method according to a first embodiment will be described with reference to FIGS. 1-3. FIG. 1 is a perspective view illustrating a winding device 10. As shown in FIG. 1, the winding device 10 comprises a coil support work 20, a work movement stage 30, a winding head 40, a head movement device 50, a control computer 60, and a motion controller 70.

The coil support work 20 is formed such that a wire 5 can be wound thereon. By winding the wire 5 along a movement path 80 set on the coil support work 20, a coil is formed. The movement path 80 set on the coil support work 20 is formed such that a desired coil is formed. The movement path 80 is shown by a two-dot chain line in FIG. 1. The movement path 80 is in an oval shape in the present embodiment, as shown in FIG. 1.

An adhesive agent is applied onto a surface 21 of the coil support work 20. Thereby, the wire 5 wound along the movement path 80 is fixed onto the surface 21 of the coil support work 20 via the adhesive agent. The adhesive agent is an example of a fixing device which fixes the wire 5 on the coil support work 20.

The work movement stage 30 supports the coil support work 20. The work movement stage 30 is formed such that the coil support work 20 can be moved along a plane defined by first and second axes 100, 110, which are orthogonal to each other. The surface 21 of the coil support work 20 is a plane parallel to a plane defined by the first and second axes 100, 110. The plane defined by the first and second axes 100, 110 is a plane perpendicular to the vertical direction, for example.

The winding head 40 includes a main body 41, a pressing member 42, and a speed measurement device 43. The main body 41 is formed so as to be moved by the head movement device 50, which will be described later. The pressing member 42 is integrally provided in the main body 41. The pressing member 42 moves together with the main body 41. The pressing member 42 is a cylindrical member extending in the vertical direction, for example. The pressing member 42 is formed such that the wire 5 can be interposed between the surface 21 of the coil support work 20 and the pressing member 42. The wire 5 is supplied from a wire supply section 200 provided outside the winding head 40.

The wire supply section 200 is a bobbin, for example, around which the wire 5 is wound. Alternatively, the wire supply section 200 may be a roller around which the wire 5 is wound. In the present embodiment, the wire 5 is extended from the wire supply section 200 as the pressing member 42 relatively moves with respect to the surface 21 of the coil support work 20.

The speed measurement device 43 includes a measurement roller 44, a pressing roller 45, and a rotary encoder 46. The measurement roller 44 is provided on the supply path 210, which supplies the wire 5 from the wire supply section 200 to the pressing member 42. The measurement roller 44 is rotatably formed. The measurement roller 44 is rotatably fixed to the main body 41, for example. The pressing roller 45 is formed such that the wire 5 can be interposed between the measurement roller 44 and the pressing roller 45. The pressing roller 45 is rotatably formed. The pressing roller 45 is urged toward the measurement roller 44 by an urging device such as a spring member, for example. Since the pressing roller 45 is urged toward the measurement roller 44, the wire 5 is interposed between the measurement roller 44 and the pressing roller 45. The pressing roller 45 is fixed to the main body 41 via the urging device, for example.

A rotary encoder 46 is formed such that rotation of the measurement roller 44 can be detected. A result of detection of the rotary encoder 46 is transmitted to a control computer 60, which will be described later.

The head movement device 50 is formed such that the main body 41 of the head 40 can be moved along the plane defined by the first and second axes 100, 110. The head movement device 50 is formed such that the main body 41 can be moved along a third axis 120. The third axis 120 is an axis extending in a direction orthogonal to the first and second axes 100, 110, and is the vertical direction in the present embodiment.

The motion controller 70 is formed such that an operation of the work movement stage 30 and an operation of the head movement device 50 can be controlled. More specifically, the motion controller 70 controls the operation of the work movement stage 30 and the operation of the head movement device 50 such that the pressing member 42 relatively moves along the movement path 80 on the basis of information on the movement path 80 input by the control computer 60, which will be described later.

The control computer 60 has first to eleventh functions, as will be described below. The first function is a function of generating coordinate information of a coil. On the basis of information on the shape of a coil input by an operator, for example, the control computer 60 generates coordinate information on coordinates defined by the first and second axes 100, 110 of the coil.

The second function is a function of generating operation information on the work movement stage 30 and operation information on the head movement device 50 for winding the wire 5 on the surface 21 of the coil support work 20. The operation information is generated on the basis of coordinate information of the coil on the coordinates defined by the first and second axes 100, 110, which is generated by the first function.

The operation information on the work movement stage 30 and the operation information on the head movement device 50 are operation information for moving the pressing member 42 along the movement path 80 of the surface 21 of the coil support work 20. For example, in the present embodiment, the work movement stage 30 includes a ball screw device which moves along the first axis 100 and a ball screw device which moves along the second axis 110. The operation information on the work movement stage 30 is information on a rotation speed of a driving part which rotatably drives a threaded portion of the ball screw device.

For example, in the present embodiment, the head movement device 50 includes a ball screw device which moves the main body 41 along the first axis 100, a ball screw device which moves the main body 41 along the second axis 110, and a ball screw device which moves the main body 41 along the third axis 120, such that the winding head 40 can be moved in a coordinate space defined by the first to third axes 100-120. The operation information for operating the head movement device 50 is information regarding a rotation speed of the driving part which rotatably drives the threaded portions of the ball screw devices, for example.

The third function is a function of calculating a target feed speed of the wire 5. The control computer 60 calculates a relative speed of the pressing member 42 with respect to the coil support work 20 on the basis of the operation information on the work movement stage 30 and the operation information on the head movement device 50. A relative speed of the pressing member 42 with respect to the surface 21 of the coil support work 20 is set as a target feed speed of the wire 5.

A detailed description will be given in this regard. As described above, the wire 5 is extended from the wire supply section 200 as the pressing member 42 relatively moves with respect to the surface 21 of the coil support work 20. Accordingly, the relative speed of the pressing member 42 with respect to the surface 21 of the coil support work 20 is theoretically the same as the feed speed of the wire. Therefore, in the present embodiment, the relative speed of the pressing member 42 with respect to the surface 21 of the coil support work 20 is set as the target feed speed of the wire 5.

The fourth function is a function of calculating an actual feed speed of the wire 5. The control computer 60 calculates the actual feed speed of the wire 5 on the basis of a result of detection of the speed measurement device 43. More specifically, the wire 5 is extended as the pressing member 42 moves with respect to the coil support work 20. That is, the number of rotations of the measurement roller 44 varies according to the actual feed speed of the wire 5.

The measurement roller 44 rotates as the wire 5 is extended. The rotary encoder 46 detects the rotation of the measurement roller 44, and transmits a signal corresponding to the number of rotations of the measurement roller 44 to the control computer 60. The control computer 60 calculates the actual feed speed of the wire 5 on the basis of the signal received from the speed measurement device 43.

The fifth function is a function of comparing the target feed speed of the wire 5 and the actual feed speed of the wire 5 described with reference to the third and fourth functions and calculating an amount of difference therebetween.

The sixth function is a function of comparing the amount of difference calculated by the fifth function with a lower limit value and an upper limit value. FIG. 2 is a graph illustrating an amount of difference between the target feed speed of the wire 5 and the actual feed speed of the wire 5, i.e., difference in speed, and an upper limit value and a lower limit value. The horizontal axis of FIG. 2 represents time. The vertical axis of FIG. 2 represents the difference in speed. An upper limit value P1 and a lower limit value P2 are values determined in advance. A detailed description on the upper limit value P1 and the lower limit value P2 will be given later.

Figure 2:
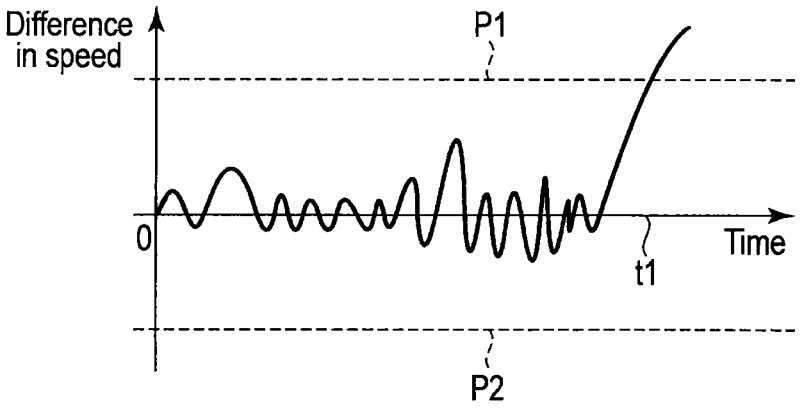
FIG. 2 is a graph illustrating a difference between an actual feed speed and a target feed speed and an upper limit value and a lower limit value of a wire wound by the winding device.
Figure 3:
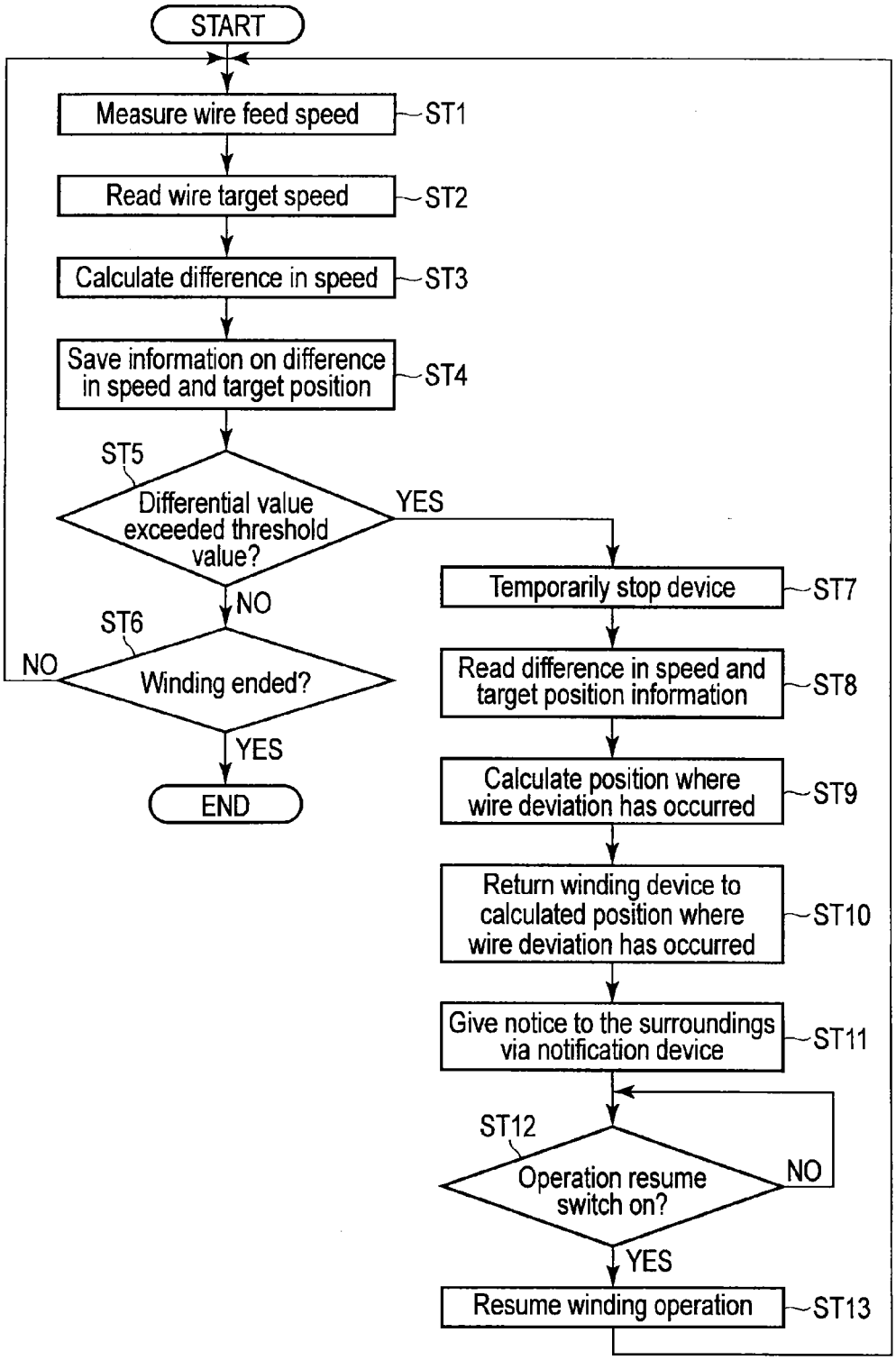
FIG. 3 is a flowchart illustrating an operation of a control computer of the winding device.

FIG. 2 illustrates a state in which a difference between the target feed speed and the actual feed speed of the wire 5 has become equal to or greater than the upper limit value P1 at time t1, by way of illustration. More specifically, FIG. 2 shows that the wire 5 has deviated from the movement path 80 at a target position at which the wire 5 should be positioned at time t1.

The seventh function is a function of storing a target position on the movement path 80 and an amount of difference between the target feed speed of the wire 5 and the actual feed speed of the wire 5 by associating the target position and the amount of difference in a storage device 90. A detailed description will be given on the seventh function. As described with respect to the first function, the control computer 60 generates operation information on the work movement stage 30 and operation information on the head movement device 50 for forming a desired coil. The control computer 60 calculates a position of the pressing member 42 on the movement path 80 on the basis of both of the operation information and positional information of the movement path 80. A plurality of target positions on the movement path 80, which are positions set on the movement path 80, are set in advance. As will be described later, the control computer 60 calculates an amount of difference between the target feed speed of the wire 5 and the actual feed speed of the wire 5 in each position and performs determination on the basis of the amount of difference. The determination and the like will be discussed in more detail later.

The control computer 60 stores positional information on each position on the movement path 80 and an amount of difference between the target feed speed of the wire 5 and the actual feed speed of the wire 5 in each position in the storage device 90 by associating the positional information with the amount of difference.

The eighth function is a function of determining whether the wire 5 has deviated from the movement path 80 on the basis of an amount of difference between the target feed speed of the wire 5 and the actual feed speed of the wire 5 and a result of comparison between the upper limit value P1 and the lower limit value P2.

A description will now be given on deviation of the wire 5 from the movement path 80. First and second deviations exist as the deviation of the wire 5 from the movement path 80.

The first deviation is a deviation of the wire 5 from between the pressing member 42 and the surface 21 of the coil support work 20. In the first deviation, since the wire 5 deviates from between the pressing member 42 and the surface 21 of the coil support work 20, a difference is generated between the target feed speed of the wire 5 and the actual feed speed of the wire 5.

For example, when the wire 5 has deviated from between the pressing member 42 and the surface 21 of the coil support work 20 while the pressing member 42 is moving along a curved portion of the movement path 80, the wire 5 cannot be pressed against the surface 21 by the pressing member 42, and is not fixed to the surface 21.

In this case, when the pressing member 42 is moving along the curved portion 81 of the movement path 80, the wire 5 does not extend along the curved portion 81, but extends from a position at which the wire 5 has deviated from between the pressing member 42 and the surface 21 on the movement path 80 to a position of the pressing member 42 along a straight line connecting the two positions. Thereby, the feed amount of the wire 5 decreases compared to the movement amount of the pressing member 42 with respect to the surface 21. In other words, the actual feed speed of the wire 5 becomes lower than the relative movement speed of the pressing member 42 with respect to the surface 21.

The second deviation is a deviation of the wire 5 fixed to the surface 21 of the coil support work 20 via an adhesive agent from the movement path 80. For example, after the wire 5 is fixed to the surface 21 of the coil support work 20 along a curved portion 81 of the movement path 80, the wire 5 exerts an elastic force to return to the original linear state from the curved state. When the elastic force is large enough to overcome the fixing force of the adhesive agent provided on the surface 21 of the coil support work 20, the wire 5 will have deviated from the movement path 80.

In this case, the amount of extension of the wire 5 tends to increase by a force exerted when the wire 5 has deviated from the surface 21 of the coil support work 20. That is, the actual feed speed of the wire 5 becomes greater than the target feed speed of the wire.

The control computer 60 determines, on the basis of a result of comparison between an amount of difference between the target feed speed of the wire 5 and the actual feed speed of the wire 5 and a result of comparison between the upper limit value P1 and the lower limit value P2, that the wire 5 has deviated from the movement path 80 when the amount of difference is equal to or less than the lower limit value P2, or when the amount of difference is equal to or greater than the upper limit value P1.

The upper limit value P1 and the lower limit value P2 are values determined in consideration of an error in the actual feed speed of the wire 5 with respect to the target feed speed of the wire 5, and can be obtained by experiments or the like.

The ninth function is a function of detecting a position at which the wire 5 has deviated from the movement path 80 on the basis of an amount of difference between the target feed speed and the actual feed speed of the wire 5, when the wire 5 is determined as having deviated from the movement path 80.

More specifically, when the control computer 60 has determined that the wire 5 has deviated from the movement path 80, the control computer 60 calculates a position at which the wire 5 had become deviated from the movement path 80 on the basis of positional information and operation information of the pressing member 42 at a target position at which the determination has been performed, positional information and operation information on the work movement stage 30 at the target position, and an amount of difference.

The tenth function is a function of stopping the operation of the work movement stage 30 and the operation of the head movement device 50 when it is determined that the wire 5 has deviated from the movement path 80. More specifically, the control computer 60 transmits a signal to the motion controller 70 so as to stop the operation of the work movement stage 30 and the operation of the head movement device 50. When the motion controller 70 receives a signal for stopping the operation of the work movement stage 30 and the operation of the head movement device 50 from the control computer 60, the motion controller 70 stops the operation of the work movement stage 30 and the head movement device 50.

The eleventh function is a function of returning the pressing member 42 to the position at which the deviation of the wire 5 from the movement path 80 has occurred, which is calculated by the seventh function, after the operation of the work movement stage 30 and the operation of the head movement device 50 are stopped.

More specifically, the control computer 60 transmits an operation instruction to the work movement stage 30 and the head movement device 50 such that the pressing member 42 returns to the position at which the deviation of the wire 5 from the movement path 80 has occurred on the surface 21 of the coil support work 20. The motion controller 70 controls the operation of the work movement stage 30 and the operation of the head movement device 50 such that the pressing member 42 returns to the position at which the deviation has occurred on the basis of a signal received from the control computer 60.

Next, an operation of the control computer 60 of the winding device 10 under operating conditions will be described. FIG. 3 is a flowchart illustrating an operation of the control computer 60. As shown in FIG. 3, the control computer 60 performs a process from step ST1 to step ST12 in each target position of the movement path 80 during an operation of winding the wire 5 on the movement path 80 on the surface 21 of the coil support work 20. A description will now be given on the operation of the control computer 60 when one of a plurality of target positions set on the movement path 80 has been reached.

In step ST1, when the target position is reached, the control computer 60 measures an actual feed speed of the wire 5 on the basis of a detection result of the speed measurement device 43. After that, the procedure proceeds to step ST2.

In step ST2, the control computer 60 calculates a target feed speed of the wire 5 in each position on the movement path 80 on the basis of operation information on the work movement stage 30, operation information on the head movement device 50, and coordinate information of the target position of the movement path 80. After that, the procedure proceeds to step ST3.

In step ST3, the control computer 60 calculates an amount of difference between the actual feed speed of the wire 5 measured in step ST1 and the target feed speed of the wire 5 calculated in step ST2. That is, a difference in speed is calculated. The difference in speed is obtained by (actual feed speed)−(target feed speed), for example. After that, the procedure proceeds to step ST4.

In step ST4, the control computer 60 stores the difference calculated in step ST3, i.e., information on the amount of difference and information on the target position at which the amount of difference has occurred, in the storage device 90. In this case, the positional information on the target position refers to the positional information on the target position described above. After that, the procedure proceeds to step ST5.

In step ST5, the control computer 60 determines whether the amount of difference between the actual feed speed and the target feed speed of the wire 5 calculated in step ST3 has exceeded a threshold value or not. The determination as to whether the threshold value has been exceeded or not means that it is determined whether the amount of difference is equal to or less than the lower limit value P2, or is equal to or greater than the upper limit value P1.

At the target position at which the operations of steps ST1-ST5 have been performed, when it is determined that a difference between the actual feed speed and the target feed speed of the wire 5 is not equal to or less than the lower limit value P2, or equal to or greater than the upper limit value P1, i.e., when it is determined that the wire 5 has not deviated from the movement path 80, the procedure proceeds to step ST6. When it is determined that the difference between the actual feed speed and the target feed speed of the wire 5 is equal to or less than the lower limit value P2 or equal to or greater than the upper limit value P1, the procedure proceeds to step ST7.

In step ST6, the control computer 60 determines whether the winding operation has ended or not. More specifically, the control computer 60 determines whether the target position, which is a target of steps ST1-5, is the position at which the winding operation has ended. Information as to whether a position is where the winding operation has ended or not is input in advance in the control computer 60.

When the control computer 60 determines that the target position is the position at which the winding operation has ended, the control computer 60 transmits a signal for ending the operation of the work movement stage 30 and the operation of the head movement device 50 to the motion controller 70. When the motion controller 70 receives a signal for ending the operation from the control computer 60, the motion controller 70 stops the operation of the work movement stage 30 and the operation of the head movement device 50, thereby ending the winding operation.

When the control computer 60 determines in step ST6 that the target position at which the operation had been performed in steps ST1-ST5 is not the position at which the winding operation has ended, the procedure returns to step ST1. When the procedure returns to step ST1, the control computer 60 performs an operation from step ST1 at the next target position of the movement path 80.

In step ST7, the control computer 60 temporarily stops the operation of the winding device 10. More specifically, the control computer 60 transmits a signal for stopping the operation of the work movement stage 30 and the operation of the head movement device 50 to the motion controller 70. Upon receipt of the stop signal from the control computer 60, the motion controller 70 stops the operation of the work movement stage 30 and the operation of the head movement device 50. After that, the procedure proceeds to step ST8.

In step ST8, the control computer 60 reads information on the target position stored in the storage device 90 and information on the amount of difference between the actual feed speed and the target feed speed of the wire 5 calculated in step ST3. After that, the procedure proceeds to step ST9.

In step ST9, the control computer 60 calculates a position at which the deviation of the wire has occurred on the basis of the information on the target position and the amount of difference read in step ST8. In other words, the control computer 60 calculates a position at which the wire 5 has deviated from the movement path 80. After that, the procedure proceeds to step ST10.

In step ST10, the control computer 60 transmits operation information on the work movement stage 30 and the head movement device 50 to the motion controller 70, in order to return the pressing member 42 to the position at which the deviation has occurred. The motion controller 70 operates the work movement stage 30 and the head movement device 50 on the basis of the operation information on the work movement stage 30 and the head movement device 50 received from the control computer 60. Thereby, the pressing member 42 returns to the position at which the deviation of the wire 5 from the movement path 80 has occurred. After that, the procedure proceeds to step ST11.

In step ST11, the control computer 60 transmits a signal for making a notification to the surroundings to a notification device 220. The notification device 220 includes a speaker, for example. The notification device 220 makes a notification sound from the speaker.

When the notification sound is made by the notification device 220, an operator recognizes that the wire 5 has deviated from the movement path 80 on the surface 21 of the coil support work 20, and that the pressing member 42 has returned to the position at which the deviation occurred.

The operator interposes the deviated wire 5 between the pressing member 42 and the coil support work 20. When the operation of interposing the wire 5 between the pressing member 42 and the coil support work 20 has ended, the operator presses an operation resume switch. When the operation resume switch is pressed, the control computer 60 proceeds to step ST12. The operation of pressing the operation resume switch is an example of an operation for making the control computer 60 recognize that the operation of interposing the wire 5 between the pressing member 42, which has returned to the return position, and the coil support work 20 has been completed, and that the winding operation can be resumed.

When the operation resume switch is pressed, the control computer 60 proceeds to step ST13. In step ST13, the control computer 60 transmits a signal for resuming the operation to the motion controller 70, in order to resume the winding operation. After that, the procedure returns to step ST1. The control computer 60 repeats the process of steps ST1-ST13 with respect to each of the target positions of the movement path 80.

In the wiring device 10 with the above-described configuration, it is possible to calculate an amount of difference between the actual feed speed and the target feed speed of the wire 5, and to determine whether the wire 5 has deviated from the movement path 80 on the basis of the amount of difference. It is therefore possible to efficiently detect deviation of the wire 5 from the movement path 80.

A detailed description will be given in this respect. In a configuration in which a winding device 10 does not detect deviation of a wire 5, unlike the present embodiment, it is necessary for an operator to detect deviation of the wire 5. In this case, since the operator visually confirms deviation, a movement path 80 of the winding device 10 needs to be constantly monitored. Further, when a plurality of winding devices 10 are simultaneously operated, since the number of operators corresponding to the number of the winding devices 10 will be required, the operation efficiency decreases.

In the present embodiment, on the other hand, it is possible to detect that the wire 5 has deviated from the movement path 80 using the speed measurement device 43 and the control computer 60. In other words, it is possible to automatically detect deviation in place of the operator. It is thus possible to efficiently detect deviation of the wire 5.

Further, when the control computer 60 has detected deviation of the wire 5 from the movement path 80, the operation of the winding device 10 is stopped. It is thereby possible to suppress the surface 21 of the coil support work 20 from being damaged. A detailed description will be given in this regard. The pressing member 42 is urged toward the coil support work 20 so as to interpose the wire 5 between the coil support work 20 and the pressing member 42. Since the pressing member 42 is urged toward the coil support work 20, the wire 5 is fixed along the movement path 80 by an adhesive agent of the surface 21 of the coil support work 20 after the pressing member 42 has relatively moved with respect to the coil support work 20.

When the wire 5 has deviated from between the pressing member 42 and the coil support work 20, however, the pressing member 42 is pressed against the surface 21 of the coil support work 20 by an urging force. When the pressing member 42 relatively moves with respect to the coil support work 20 in this state, the surface 21 of the coil support work 20 may be damaged by the pressing member 42.

In the present embodiment, on the other hand, when the control computer 60 has detected that the wire 5 has deviated from the movement path 80, the control computer 60 stops the operation of the winding device 10. Since the relative movement of the pressing member 42 with respect to the coil support work 20 is stopped as the operation of the winding device 10 is stopped, the coil support work 20 is suppressed from being damaged by the pressing member 42.

Further, when the control computer 60 has detected deviation of the wire 5 from the movement path 80, the pressing member 42 returns to the position at which the deviation has occurred on the movement path 80. Accordingly, the operator needs to perform only the operation of interposing the wire 5 between the pressing member 42 and the coil support work 20, the return operation of the winding device 10 can be efficiently performed.

Further, since the notification device 220 makes a notification, the surrounding operators can recognize that the wire 5 has deviated from the movement path 80.

Next, a winding device and a winding method according to a second embodiment will be described with reference to FIGS. 4 and 5. A structure having a function similar to that of the first embodiment will be denoted by the same reference numerals and a detailed description of such a structure will be omitted. The present embodiment is different from the first embodiment in that a robot arm 250 is further provided. Since the robot art 250 is provided, the operation of the control computer 60 is different from that of the first embodiment. The other structures are the same as those of the first embodiment.

Figure 4:
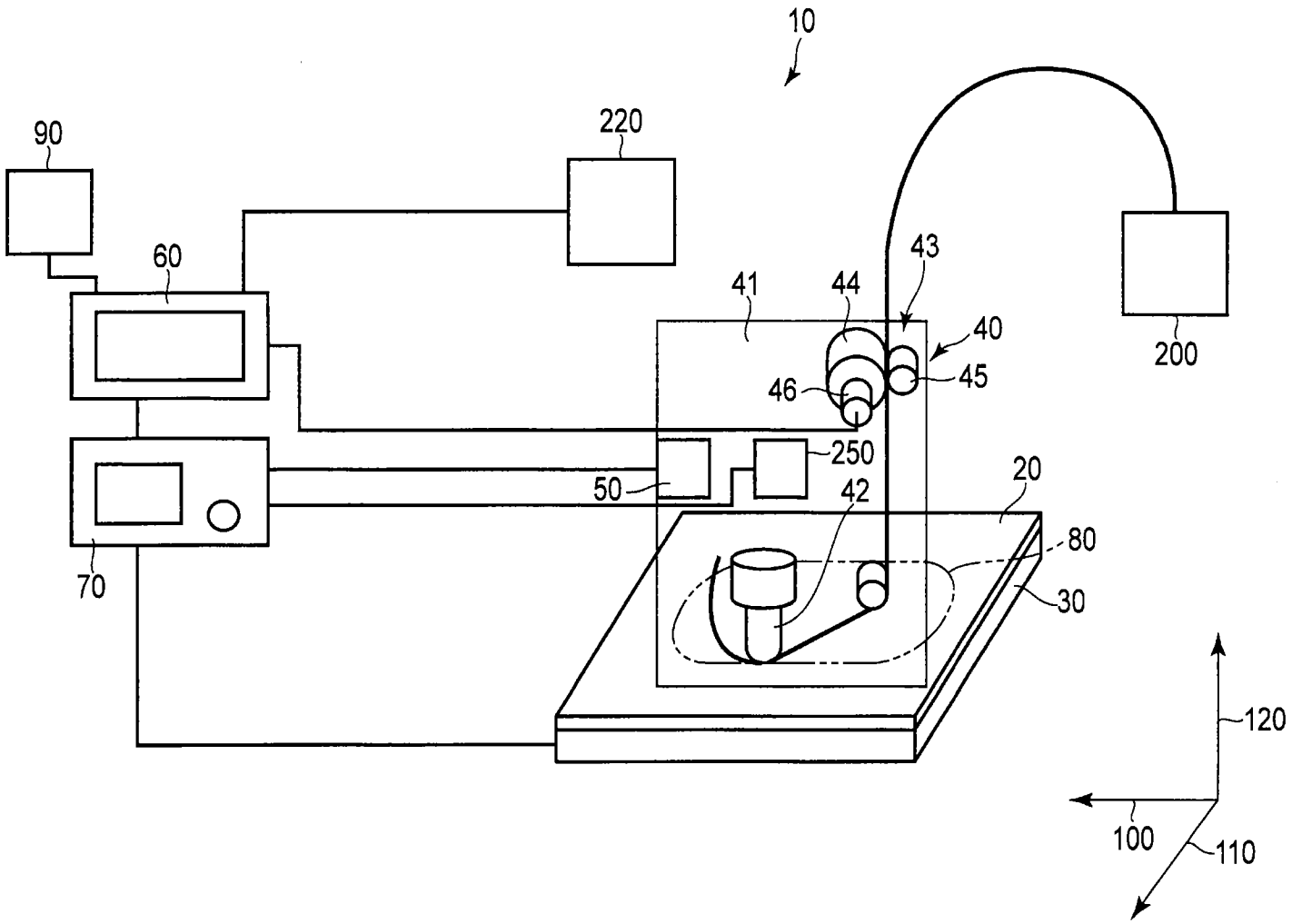
FIG. 4 is a schematic view illustrating the winding device according to the second embodiment.

FIG. 4 is a schematic diagram illustrating a winding device 10 of the present embodiment. As shown in FIG. 4, the winding device 10 further includes a robot arm 250, in addition to the structures described with reference to the first embodiment. The robot arm 250 is configured to grip a wire 5 that has deviated from the movement path 80 so as to interpose the wire 5 between a pressing member 42 which has returned to a position at which the deviation occurred and a coil support work 20, under control of the control computer 60.

Figure 5:
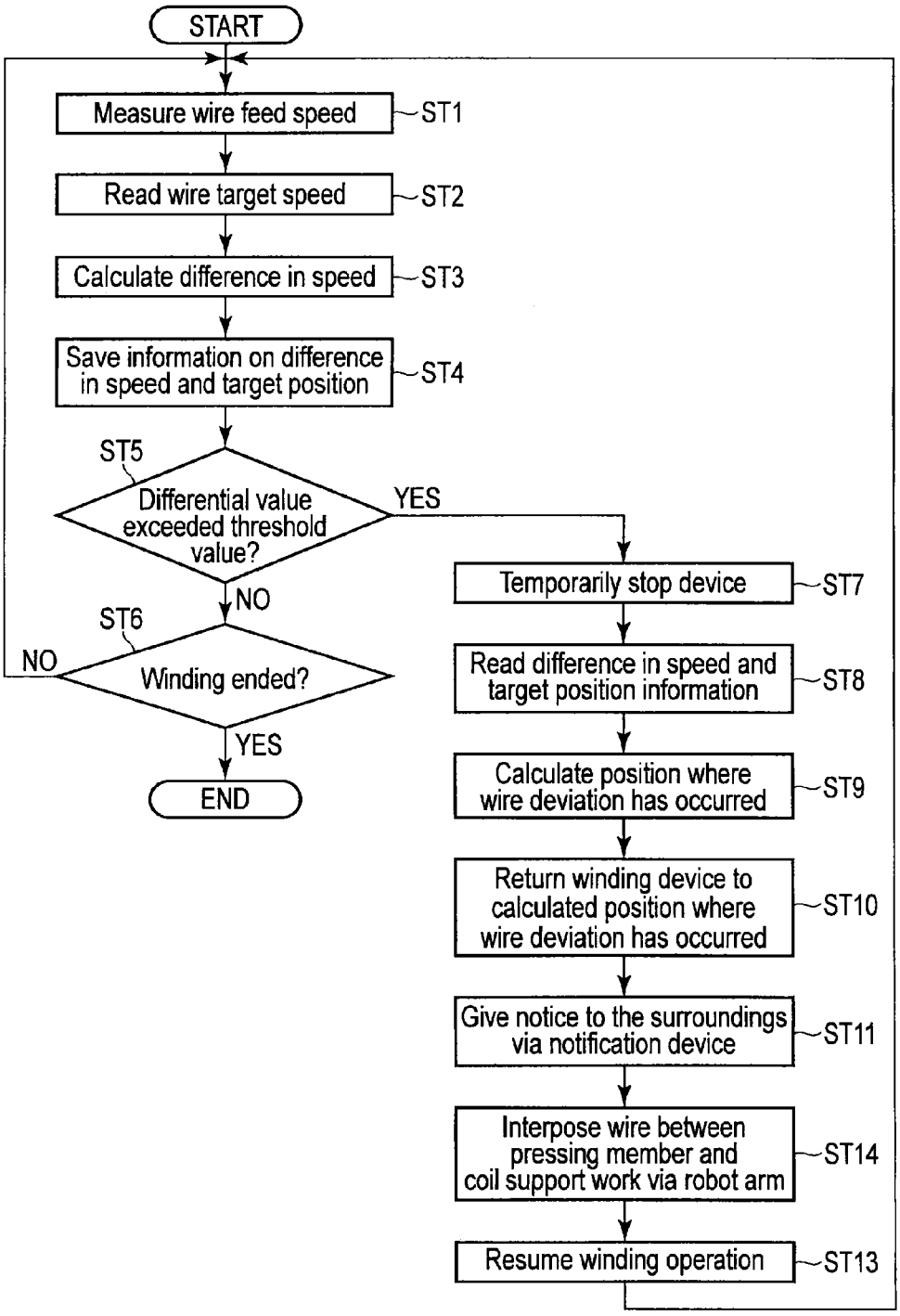
FIG. 5 is a flowchart illustrating an operation of the winding device.

FIG. 5 is a flowchart illustrating an operation of the control computer 60 according to the embodiment. As shown in FIG. 5, the control computer 60 performs step ST14, instead of step ST12, in the present embodiment. After step ST11, the procedure proceeds to step ST14.

In step ST14, the control computer 60 controls the robot arm 250 so as to cause the robot arm 250 to interpose the deviated wire 5 between the pressing member which has returned to the position at which the deviation occurred and the coil support work 20. After that, the procedure proceeds to step ST13.

In the present embodiment, the operation of the winding device 10 can be efficiently resumed after the wire 5 has deviated, in addition to the effect described with reference to the first embodiment.

In the present embodiment, since the wire 5 is interposed between the pressing member 42 and the coil support work 20 by the robot arm 250, a notification device 220 for making a notification that the wire 5 has deviated to the surroundings does not need to be provided.

The robot arm 250 is an example of an interposing device for interposing the deviated wire 5 between the pressing member 42 and the coil support work 20.

In the first and second embodiments, the coil support work is an example of a supporting part. The control computer 70 is equipped with functions as a control part, a target movement speed calculation part, a wire feed speed detection part, a deviation amount calculation part, and a determination part. The work movement stage 30 and the head movement device 50 form an example of a movement part. The speed device 43 and the control computer 70 form an example of a wire feed speed detection part.

The notification device 220 may make a notification to the surroundings by turning on a lamp, instead of causing the speaker to make a sound.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A winding device comprising:

a supporting part configured to support a wire;

a pressing part configured to interpose the wire between the supporting part and the pressing part;

a movement part configured to move a positional relationship between the supporting part and the pressing part;

a control part configured to control an operation of the movement part;

a target movement speed calculation part configured to detect a target relative movement speed of the pressing part with respect to the supporting part on the basis of information on a predetermined movement path on which the pressing part moves with respect to the supporting part and operation information on the movement part;

a wire feed speed detection part configured to detect a feed speed of the wire involved in the relative movement of the pressing part with respect to the supporting member;

a deviation amount calculation part configured to calculate a difference between a detection result of the target movement speed calculation part and a detection result of the wire feed speed detection part; and a determination part configured to determine that the wire has deviated from the movement path on the basis of a result of calculation of the deviation amount calculation part.

2. The winding device according to claim 1, wherein the control part stops the operation of the movement part when the determination part determines that the wire has deviated from the movement path.

3. The winding device according to claim 2, further comprising:

a storage part configured to store information on a target position on the movement path and the detection result of the deviation amount calculation part at the target position by associating the information on the target position with the detection result; and a deviation position calculation part configured to calculate a position at which the deviation of the wire from the movement path has occurred on the basis of the target position stored in the storage part and the calculation result of the deviation amount calculation part associated with the target position, when the determination part determines that the wire has deviated from the movement path.

4. The winding device according to claim 3, wherein the control part controls the movement part to cause the pressing part to return to the position at which the deviation has occurred on the basis of the calculation result of the deviation position calculation part when the determination part has detected deviation.

5. The winding device according to claim 1, further comprising:

a storage part configured to store information on a target position on the movement path and the detection result of the deviation amount calculation part at the target position by associating the information on the target position with the detection result; and a deviation position calculation part configured to calculate a position at which the deviation of the wire from the movement path has occurred on the basis of the target position stored in the storage part and the calculation result of the deviation amount calculation part associated with the target position, when the determination part determines that the wire has deviated from the movement path.

6. The winding device according to claim 5, wherein the control part controls the movement part to cause the pressing part to return the position at which the deviation has occurred on the basis of the calculation result of the deviation position calculation part when the determination part has detected deviation.

7. The winding device according to claim 1, further comprising:

a notification part configured to make a notification that deviation of the wire from the movement path has occurred, when the determination part has detected the deviation.

8. A winding method comprising:

detecting a target relative movement speed of a pressing part with respect to a supporting part on the basis of information on a predetermined movement path along which the pressing part moves with respect to the supporting part configured to support a wire and operation information on the pressing part;

detecting a feed speed of the wire involved in the relative movement of the pressing part with respect to the supporting part;

calculating a difference between a detection result of a target movement speed calculation part and a detection result of a wire feed speed detection part; and determining that the wire has deviated from the movement path on the basis of a result of calculation of the difference.

9. The winding method according to claim 8, wherein a winding operation of the wire on the supporting part is stopped when it is determined that the wire has deviated from the movement path.

10. The winding method according to claim 9, further comprising:

storing information on a target position on the movement path and a result of calculation of the difference at the target position by associating the information on the target position with the result of calculation; and calculating a position at which deviation of the wire from the movement path has occurred on the basis of the stored target position and the result of calculation of the deviation amount associated with the target position when it is determined that the wire has deviated from the movement path.

11. The winding method according to claim 10, further comprising:

causing the pressing part to return to the position at which the deviation has occurred when it is detected that the wire has deviated from the movement path.

12. The winding method according to claim 8, further comprising:

storing information on a target position on the movement path and a result of calculation of the difference at the target position by associating the information on the target position with the result of calculation; and calculating a position at which deviation of the wire from the movement path has occurred on the basis of the stored target position and the result of calculation of the deviation amount associated with the target position when it is determined that the wire has deviated from the movement path.

13. The winding method according to claim 12, further comprising:

causing the pressing part to return to the position at which the deviation has occurred when it is detected that the wire has deviated from the movement path.

14. The winding method according to claim 8, further comprising:

making a notification that the deviation has occurred when it is detected that the wire has deviated from the movement path.

* * * * *